United States Patent [19]

Tsuchiya

[11] 3,933,490

[45] Jan. 20, 1976

[54] IMPROVEMENTS IN TRANSFER ELECTROPHOTOGRAPHY

[75] Inventor: Hiroshi Tsuchiya, Urawa, Japan

[73] Assignee: Canon Kabushiki Kaisha, Tokyo, Japan

[22] Filed: Aug. 12, 1974

[21] Appl. No.: 496,837

Related U.S. Application Data

[63] Continuation of Ser. No. 301,220, Oct. 26, 1972, abandoned.

[30] Foreign Application Priority Data

Nov. 4, 1971 Japan ..... 46-87762

[52] U.S. Cl. ..... 96/1.4; 96/1 LY; 427/16; 427/17

[51] Int. Cl.[2] ..... G03G 13/14; G03G 13/10

[58] Field of Search ..... 96/1 LY, 1.4; 117/37 LE; 355/10; 427/16, 17

[56] References Cited

UNITED STATES PATENTS

| | | | |
|---|---|---|---|
| 3,461,843 | 8/1969 | Noon | 117/37 LE |
| 3,576,623 | 4/1971 | Snelling | 96/1 LY |
| 3,663,219 | 5/1972 | Takahashi | 96/1.4 |
| 3,722,994 | 3/1973 | Tanaka et al. | 117/37 LE X |
| 3,783,826 | 1/1974 | Urbanek et al. | 96/1 LY X |

FOREIGN PATENTS OR APPLICATIONS

| | | | |
|---|---|---|---|
| 274,610 | 3/1965 | Australia | 96/1.4 |
| 45-7790 | 2/1971 | Japan | 96/1 LY |

*Primary Examiner*—Roland E. Martin, Jr.
*Attorney, Agent, or Firm*—Toren, McGeady and Stanger

[57] ABSTRACT

An improved process of transfer electrophotography employing a liquid developer is described. The depth of the developer on the surface of a an electrophotographic photosensitive member on which an electrostatic latent image to be developed is formed is controlled to a value in the range of 5–30 $\mu$ prior to transfer. The developer image is transferred to a copying material having an oil absorption coefficient greater than 50 seconds in such a way that the controlled depth of the developer on the photosensitive member is reduced to a value in the range of 2–15$\mu$. After transfer, the photosensitive member is cleaned to reduce the depth of the remaining developer to a value no greater than 1$\mu$.

19 Claims, No Drawings

IMPROVEMENTS IN TRANSFER ELECTROPHOTOGRAPHY

This is a continuation of application Ser. No. 301,220, filed Oct. 26, 1972, now abandoned.

BACKGROUND OF THE INVENTION

1. Field of the Invention

The present invention relates to an electronic photography using a liquid developer, the technique generally comprises developing electrostatic latent images formed on a photosensitive member electronic photography with a liquid developer, transferring the developed figures to a transfer material, and cleaning the said photosensitive body after transferring for reuse.

2. Description of the Prior Art:

Various methods of electrophotography have been reported. Among them the following are commonly employed.

The first is a process in which a layer such as, for example, of a ZnO-resin binder system and a polyvinylcarbozol is formed on the surface of a supporting material generally of paper or a resin film which has been made electroconductive. The layer is statically charged uniformly, and electrostatic latent images are formed by irradiating the layer surface with original figures. The formed images are developed with a developer either in a dry or wet process, and are then fixed on the photoelectroconductive layer, (for example, by heating) to obtain a duplicate. This process belongs to the field of non-tranfer electrophotography.

The second is a process in which a conductive layer, for instance, of amorphous selenium and of the ZnO-resin binder system on a supporting material generally of a metal plate, is charged uniformly: Electrostatic latent images are formed by irradiating the surface with original figures, and are developed with a dry developer; The developed figures are transferred to a material such as a sheet of paper and fixed by heating to obtain a duplicate. The photoconductive layer can be repeatedly used after being cleaned.

The third is a process in which electrostatic latent images are formed on a photosensitive plate having on the immediate surface a photoelectroconductive layer, for example, of CdS and further on it an insulating layer is submitted to the corona charging uniformly on the whole surface, irradiated with original figures with simultaneous corona charging of the reversed phase or the alternating current charging, uniformly exposed to light to form electrostatic latent images, which are subsequently developed with a dry developer and the developed figures are transferred to a material such as a sheet of paper and are then fixed by heating to obtain a duplicate. The photosensitive plate can be repeatedly used after being cleaned.

The processes referred to as the second and the third kinds belong to the field of transfer.

Transfer electrophotography using a liquid developer has not been developed to practical use owing to various technical difficulties.

SUMMARY OF THE INVENTION

The present invention has solved such various technical difficulties accompanying the transfer-type electrophotography using a liquid developer, and has especially improved the technique of transferring, the characteristics of the transfer material and the technique of cleaning.

The present invention intends to provide a process of electrophotography in which electrostatic latent images formed on a photosensitive body for electronic photography are developed with a liquid developer, after which the depth of the remaining developer liquid on the photosensitive body member is controlled to improve the efficiency of transferring and fixing and to enhance the resulting resolution resolving of the transferred figures.

The second aim of this invention is to provide a transfer material to which figures of good quality can be transferred. A further aim of this invention is to provide a technique for cleaning the photosensitive member so that the member can be repeatedly used.

As has been mentioned above, the present invention represents an improvement in transfer electrophotography in which electrostatic latent images formed on a photosensitive body for electronic photography are developed with a liquid developer after which the developed figures are transferred to a transfer material and the photosensitive body is cleaned so that it may be repeatedly used.

In order to attain high efficiency in transferring such developed images to a transfer material an appropriate amount of the liquid developer must be present at the time of transferring between the photosensitive member coated thereby and the transfer material (usually a paper sheet). If an empty space is formed between the photosensitive member and the paper sheet in which the developer is not present, transferring does not take place at such part. This is because the transfer of visible figures in the wet developing process relies mostly on electromigration. On the other hand, if the developer is present in excess on the photosensitive member, developed figures are transferred to the transfer material, but at the same time a flow or shift of the figures is apt to occur which deteriorates resolution of the transferred figures. Further, the absorption of the developer into the transfer material either takes a long time or requires a large capacity heating source to dry the transfer material and to fix the visible figures. In addition, vapor from the liquid developer during this phase spoils the hygienic condition of the environment.

The above difficulties must be removed to improve the efficiency of transferring. Additionally, since the developed sensitive member cannot be completely transferred to a transfer material, the member should be cleaned after each use.

For repeated use the photosensitive member should ideally be completely free from the developer solution after cleaning. However, complete removal of the developer makes it necessary to press the surface of the photosensitive member fairly strongly with a blade, which may injure the surface or lessen its durability.

If, on the other hand, the cleaning pressure is insufficient, the developer solution will be not completely removed and as a result it will form a thin layer on the surface. This a phenomenon known as "fogging".

A feature of the invention is an excellent method of cleaning which does not injure the photosensitive member or bring about fogging. Using this method as well as the improved method of transferring mentioned above, the technique of transfer-type electrophotography involving the use of a liquid developer has been remarkably improved.

In general, the present invention contemplates an improved process of electrophotography comprising the steps of developing with a liquid developer electrostatic latent images formed on a photosensitive body for electronic photography composed of a supporting material and a photoelectroconductive layer as basic constituents, of controlling the liquid depth of the developer solution on the photosensitive body to 5 to 30$\mu$ by squeezing by the corona discharge, of electrostatically transferring the developed figures on the photosensitive body to a transfer material and fixing the transferred image cleaning the photosensitive member after the transfer treatment so that no more than a 1$\mu$ thick layer of the liquid developer remains thereon.

DESCRIPTION OF THE PREFERRED EMBODIMENT

The photosensitive member to be used in this invention for forming electostatic latent images on its surface is required at least to have the following properties in order to perform the present invention with efficiency and to obtain satisfactory results:

1. it should be impermeable to and non-dissolving in the developer (mainly in the supporting liquid).
2. it should have sufficient electrical voltage tolerance to hold electrical charge.
3. it should have high enough mechanical tolerance to be repeatedly used.

The photosensitive member conventionally be prepared by applying or vacuum-evaporating, on a support layer, an inorganic photoelectroconductive material such as ZnO, Se or CdS, an organic photoelectroconductive material such as N-vinylcarbazol or oxyadiazol, and a photoelectroconductive layer composed of a dispersoid system of a photoelectroconductive material and a binder. It may also be prepared by providing a top layer on a photoelectroconductive layer, or by applying on a photoconductive material and/or a binder a selected material having the above three requirements (1) to (3).

A photosensitive member suitable to the present invention may be that employed in connection with the electrophotographic technique described in Japanese Patent Publication Sho 42-23910 such member is composed at least of an electroconductive supporting material, photoelectroconductive layer and an insulating layer.

In one illustrative transfer electrophotography technique contemplated by the invention, the member photosensitive body is formed in the shape of a drum either by vacuum-evaporating a photosensitive material onto a drum-shaped supporter or by applying a flexible plate of photosensitive material around a drum-shaped supporter. Disposed at spaced angular intervals around the drum periphery are, e.g., a corona discharger, an irradiator a liquid developer station, a corona discharge squeezer for controlling the liquid depth of developer, a discharger for transferring and a cleaning apparatus to clean the photosensitive body are placed.

Latent images of original figures may be prepared according to the descriptions in Japanese Patent Publication Sho 42-23910 and 44-2560.

Typical liquid developers are composed of an insulating liquid having resistivity greater than $10^9$ ohm-cm, toner particles, and a charge controller. One suitable type of liquid developer is described in Japanese Patent Publication Sho 35-5511, 35-13424 and 36-14872, where the average diameter of toner particles lies between 0.5 and 10.0$\mu$. preferably 1.0 and 5.0$\mu$. Smaller particles lower the efficiency in transfer and larger particles lose the fine structure of figures.

Contact of these liquid developers with the photosensitive surface causes the visualization of the electrostatic latent images formed on the photosensitive member.

The photosensitive body member is then transferred to the next stage of treatment, carrying on the surface a large amount of insulating liquid as well as toner particles forming the visible images.

Since the insulating liquid is necessary for transferring, some amount of the liquid should to be present on the surface. However, since such presence in a large amount should be avoided as was mentioned above, the photosensitive body is subsequently transferred to the corona discharge squeezing apparatus to control the liquid depth of the developer solution remaining on the surface of photosensitive body after the image is developed.

In accordance with the invention the appropriate depth of developer solution on the surface of photosensitive body is approximately 5 to 30$\mu$, especially 10 to 20$\mu$. As a result of experiment, it has been determined that a developer depth less than 5$\mu$ produces a space between the photosensitive member and a transfer material, which leads to non-uniformly transferred figures so that good quality duplicates can not readily be obtained. On the other hand, if the liquid depth is thicker than 30$\mu$, the developer is so seriously impregnated in the transfer material that fixing and drying become remarkably difficult and furthermore the resolution of the transferred figures is lowered.

A typical procedure in accordance with the invention and the results obtained thereby are shown below.

A mixed dispersoid consisting of 100 g of microcrystalline cadmium sulfide, 10 g of a 50% solution in toluene of a vinyl chloride-vinyl acetate copolymer and 80 g of toluene was applied on a 0.05 mm thick foil of aluminum so as to obtain a 40$\mu$ thick dried layer. A 38$\mu$ thick insulating film of polyethyleneterephthalate was fixed on this layer with an epoxy resin adhesive of low temperature hardening type, to produce a triple layer photosensitive member. The surface of the insulating layer of the above photosensitive member was uniformly charged by a direct current corona discharge at + 7 KV. The electrostatic latent image was obtained when such charged surface was irradiated with original figures during an alternating current corona discharge at 7 KV, followed by exposure of the whole surface to light to obtain electrostatic latent images.

To prepare the liquid developer, a mixture consisting of

| | |
|---|---|
| Cyclic rubber | 3 g |
| Low-molecular weight polyethylene | 2 g |
| Carbon black | 2 g |
| Xylene | 30 g |

was dispersed and kneaded for 12 hours with a ball mill, and then dispersed with a homogenizer in 1 liter of an electrically insulating liquid (e.g., that supplied under the commercial name Isopar G) containing 40 mg of lecithin. The average diameter of particles in this developer was 2 to 3$\mu$. Using this developer the electrostatic latent images were developed and thereby clear figures (density 1.7) were produced on the surface of photosensitive member. The developer solution remaining on the photosensitive member was about 60$\mu$ thick.

Subsequently the corona discharge squeezing step performed at the discharge voltage as shown in the table below to control the liquid depth of the developer remaining on the surface of photosensitive body, and the figures were transferred by a corona transfer step in about 0.25 sec. to a transfer paper having a 135 sec. oil absorption coefficient and a 100 sec. surface smoothness, and the transferred figures were fixed by drying with hot air. Density, resolution and dryness index were measured. The density of the figures was measured with a reflection densitometer. The dryness index was estimated by the formula:

$$\frac{\left(\text{Amount of liquid contained in the paper after the drying procedure}\right)}{\left(\text{Amount of liquid contained in the paper immediately after the transfer}\right)} \times 100\ (\%)$$

where the drier used was of a direct heating type by infrared light (800W wattage) with a 10 mm distance between the heater wall and the transfer paper. The speed of advance of the transfer paper was 100 mm/sec.

| Voltage of corona discharge squeezing | Liquid depth before the transfer ($\mu$) | Density of transferred figure | Dryness index (%) | Resolution power (lines in mm) | Non-uniformity of transferred figure |
|---|---|---|---|---|---|
| 7.2 | 2 – 3 | 1.25 | 98 | 8 | yes |
| 7.0 | 5 – 6 | 1.40 | 95 | 6.3 | almost no |
| 6.5 | 10 – 12 | 1.47 | 91 | 6.3 | no |
| 6.2 | 18 – 20 | 1.55 | 85 | 6.3 | no |
| 6.0 | 28 – 30 | 1.65 | 80 | 5.6 | no |
| 5.5 | 38 – 40 | 1.68 | 70 | 4.5 | no |

Note: The corona discharge squeezing was performed with a 0.06mm gold-plated tungsten wire with the distance between the photosensitive body and the wire being about 10 mm.

The optimum time for transferring according to the technique of this invention is approximately 0.2 to 1.0 sec. depending on the developers and conditions of transfer. The transfer materials are required to have a high anti-solvent property (or high anti-oil absorption property), because absorption of developer is not desirable during the period of transfer. Further, the transfer materials are also required to have a smooth surface to attain better contact with the photosensitive member.

Consequently, the transfer materials (e.g., paper) used in the present invention are required to have an oil absorption coefficient exceeding 50 sec. or and anti-oil absorption property over 0.5 sec.

Additionally, they should have a surface coarseness (or surface smoothness) over 30 sec., preferably 50 to 150 sec. The oil absorption coefficient is defined as the time in seconds necessary for the disappearance of the reflection images of a point light source from on the surface of a drop (0.004 cc) of Isopar G which is placed on a horizontally disposed piece of the paper to be tested. The drop is applied with an injector equipped with a hypodermic injector needle (HS, 0.5+0.02 to 0.5–0.01 mm outer diameter, 23 ± 1 mm length and 12° point angle). Such time is indicative of the duration over which a drop of the liquid is entirely absorbed in the paper to be tested. The anti-oil absorption property is expressed by the time in seconds in which a drop of Isopar G placed in the same manner as in the case of the oil absorption coefficient measurement makes transparent the whole area (approximately 10 mm $\phi$) of the paper under the drop. The surface coarseness is expressed by the Beck method in accordance with JIS - P8119.

The step of transferring the image should be so carried out that about 20 to 50%, preferably about 30%, of the controlled liquid depth of 5 to 30$\mu$ of the developer on the surface of the photosensitive body before the transfer remains on the surface after the transfer; preferably, a 2 to 15$\mu$ depth of developer solution should remain after transfer. This is the necessary to avoid blurs of the transferred figures and to control blots of developer on the transfer material, attributable to surface coarseness and the anti-oil absorption property of the transfer material.

After the transfer, the photosensitive body after the transfer is transported to the cleaning apparatus to remove the 2 to 15$\mu$ depth of liquid remaining on the surface of photosensitive body.

Cleaning can be performed by pressing a blade, a roller or a brush against the photosensitive body to remove the remaining solution. The cleaning should be conducted so that the depth of the developer solution on the surface of photosensitive member is less than 1$\mu$ after the cleaning step. For that purpose, for example, the blade material may be polyurethane resin, and the blade is applied to the photosensitive member with a pressure larger 5 Kg/cm$^2$.

The present invention will be illustrated by the following examples.

EXAMPLE 1

A photosensitive member was prepared by applying on a 60$\mu$ thick aluminum foil a solution in toluene and chlorobenzene of 2,5-bis(p-diethylaminophenyl)-1,3,4-oxadiazol as photoelectroconductive material, polycarbonate (commercial name Yubin E 2000 by Mitsubishi Resin Co.) as binder resin and Rhodamine B as a sensitizing agent in the ratio 1 : 1 : 0.015 by weight so as to obtain a film having a dried thickness of 10$\mu$.

The surface of the above photosensitive member was uniformly charged by the corona discharge at −5.5 KV, and exposed to original figures to form electrostatic latent images. The images were developed with a commercially available liquid developer and thereby clear figures were produced on the surface of the photosensitive member. The developer solution remaining on the surface of the photosensitive member after such developement was about 60$\mu$ deep. The liquid depth of the developer was then controlled to about 15$\mu$ by the corona discharge at 6.5 KV, and then transferred in about 0.2 sec. by corona transferring step to a transfer paper having an oil absorption coefficient of 135 sec. and a surface smoothness 100 to 120 sec. This tranfer step was followed by cleaning of the photosensitive member with a polyurethane blade so that the liquid depth was reduced to less than 1$\mu$.

The above process was repeatedly applied. Results were sufficiently satisfactory for each run to provided clear and distinct duplicates.

EXAMPLE 2

A photosensitive member was prepared as in Example 1 by applying on a 60$\mu$ thick aluminum foil a toluene and chlorobenzene solution of 2,5-bis(p-dimethylaminophenyl)-1,3,4-oxadiazol as photoelectroconductive material, acrylonitrilestyrene copolymer resin (e.g., that supplied under the commercial name Estyrene A - 20 by Union Carbide Co.) as a binder resin and a coloring material having the following structural formula as a sensitizing agent

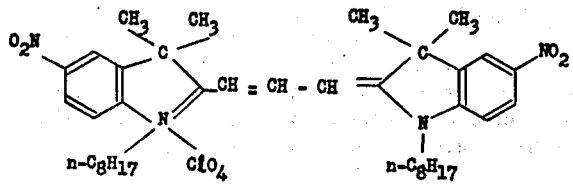

in the ratio of 1 : 1 : 0.015 by weight so as to obtain a 10$\mu$ film having a dried thickness. Subsequent treatment was same as in Example 1 and clear and distinct duplicates were obtained.

EXAMPLE 3

A mixture of 150 ml of acetonitrile containing 4 g of cuprous iodide and 30 ml of a 5% solution of polyvinylformal was applied to a 90$\mu$ thick plate of polyethyleneterephthalate and was dried to make the surface of the plate electroconductive. Then a solution containing 3 g of vinyl acetate resin per 500 ml was applied to the surface of the plate so that a 6$\mu$ thick dried film could be obtained. By further applying to the above product a solution having the following composition so as to obtain a 7$\mu$ thick dried film, a triple layer photosensitive member was prepared:

| | |
|---|---|
| Poly-N-vinylcarbazol | 2 g |
| 2,4,7-Trinitrofluorenone | 2 mg |
| 3,3', 3''-Tricarbazolylmethylchloride | 5 mg |
| Monochlorobenzene | 50 mg |

The surface of the above photosensitive member was uniformly charged by the corona discharge at +7.0 KV, and exposed to the original figures to form electrostatic latent images. The electrostatic latent images were developed with a known liquid developer to produce clear images on the surface of the photosensitive member. Then the liquid depth on the photosensitive member was controlled to about 15$\mu$ by the corona discharge at −6.5 KV, and the images were transferred to a sheet of paper having an the oil-absorption coefficient of 135 sec. and a surface smoothness of 100 sec. Cleaning of the photosensitive member with a blade followed. The above process was repeated and the results obtained were as good as in Example 1.

EXAMPLE 4

To the surface of a well polished aluminum drum 99.999% pure selenium was plated by vacuum evaporation to a thickness of 50 to 60$\mu$ under a vacuum of 2 to 5 × $10^{-5}$ mmHg and at a base temperature 65°C, thereby obtaining a double layer photosensitive member. The surface of the photoconductive layer was then uniformly charged by the corona discharge at +7 KV, and exposed to original figures to form electrostatic latent images. The images were developed in the same manner as in Example 1 with a liquid developer to produce clear images on the surface of the photosensitive member. By analogy to in Example 1, the depth of liquid on the photosensitive member was controlled to about 20$\mu$ by use of the corona discharge at −6.2 KV, and then the images were transferred to a sheet of paper having an oil-absorption coefficient of 135 sec. and a surface smoothness of 110 sec. Cleaning with a rotating brush followed so that the depth of remaining developer solution was reduced to less than 1$\mu$. The above process was repeated and good results were obtained as in Example 1.

When a drum on whose surface selenium is plated by vacuum evaporation is used as a photosensitive member and the development is performed with a liquid developer, the surface material of the photosensitive member tends to be rapidly converted into a crystalline form, which unfavorably influences the figure formation.

However by virtue of, the cleaning step in the technique of the present invention, in which the depth of the liquid on the photosensitive member is reduced below 1$\mu$ by treating with a blade, a roller or a brush, the crystallized layer is significantly removed along with the liquid developer on the surface of photosensitive body. Therefore inactivation of the photosensitive body due to crystallization of the surface layer can be prevented and figures of good quality can be obtained.

EXAMPLE 5

A mixture consisting of 100 g of microcrystalline cadmium sulfide, 10 g of a 50% solution in toluene of vinyl chloridevinyl acetate copolymer and 80 g of toluene was applied to a 0.05 mm thick foil of aluminum so as to form a 40$\mu$ thick dried film. Over this film was applied a 33$\mu$ thick insulating film of polyethyleneterephthalate fixed with an epoxy resin adhesive of the low temperature hardening type, to produce a triple layer photosensitive member. The surface of the insulating layer of the photosensitive member was uniformly charged by the corona discharge at +7 KV, then exposed to original figures during an alternating current corona discharge at 7 KV, and further exposed uniformly to light in order to form electrostatic latent images.

Subsequently, a mixture consisting of

| | |
|---|---|
| Cyclic rubber | 3 g |
| Low-molecular polyethylene | 2 g |
| Carbon black | 2 g |
| Xylene | 30 g |

was dispersed and kneaded for 12 hours with a ball mill, and dispersed in 1 liter of Isopar G containing 40 mg of lecithin with a homogenizer, to produce a liquid developer. Using this developer, the above electrostatic latent images were developed to obtain clear figures on the surface of the photosensitive member. The depth of the developer solution on the surface was about 60$\mu$.

Next, the corona discharge step was conducted at 6.4 KV to reduce the depth of developer solution on the surface of photosensitive member to 15$\mu$. Then the figures were transferred in 0.25 sec. by the corona transferring method to a transfer paper having an oil-absorption coefficient of 150 sec. and a surface smoothness 100 sec., and the transferred figures were dried with hot air. Extremely clear and well-fixed figures were produced.

The depth of developer solution remaining on the photosensitive member after the transfer was about 5μ. This was reduced to less than 1μ by cleaning with a polyurethane blade. The process was repeatedly applied. Results obtained were always good.

EXAMPLE 6

A zinc oxide-resin paste composed of the components indicated below was applied to a 0.05 mm thick foil of aluminum with a wire bar so that a 18 to 22μ thick dried coating film was formed. Thus, a double layer photosensitive member was prepared.

| Zinc oxide-resin paste | (parts by weight) |
|---|---|
| Photoelectroconductive zinc oxide | 100 parts |
| Polyvinylbutylal (e.g., that supplied under the commercial name BM-2 by Sekisui Chemicals Co.) | 375 parts |
| Acrylic resin (e.g., that supplied under the commercial name LR-472 by Nippon Reichhold Co.) | 125 parts |
| Isopropyl alcohol | 700 parts |
| Xylene | 800 parts |
| Rose Bengale (methanolic solution) | 3 parts |

The above components were mixed with a ball mill and then diluted with a mixed solvent of isopropyl alcohol and xylene until the particle size was reduced to about 600 c.p. The resulting mixture was applied to the aluminum foil.

The surface of the above photosensitive member was uniformly charged by the corona discharge at −7.4 KV, and then exposed to original figures to form electrostatic latent images. The carbon black-resin mixture prepared in Example 5 was dispersed with a homogenizer in 1 liter of Isopar G containing 100 mg of cobalt naphthenate to prepare a liquid developer. Using this developer, the electrostatic latent images were developed and clear figures were formed on the surface of the photosensitive member. The depth of developer solution on the surface was controlled to about 15μ by applying the corona discharge at +7 KV, and then the images were transferred by corona transfer to a sheet of paper having an oil-absorption coefficient 135 sec. and a surface smoothness of 120 sec. Such transfer step was followed by cleaning of the photosensitive member with a rotating brush. The process was repeatedly applied. Results were as good as in Example 1.

EXAMPLE 7

In the same manner as in Example 1, visible figures were formed on a photosensitive member with the depth of liquid developer being about 60μ.

Subsequently, the corona discharge squeezing step was conducted at 7.0 KV to control the liquid depth on the surface of the photosensitive member to 5 to 6μ. The figures were then transferred by use of corona transfer in about 0.25 sec. to a transfer paper having an oil-absorption coefficient of 600 sec. and a surface smoothness of 300 sec. The transferred figures were dried with hot air. Figures obtained were extremely clear and well-fixed.

After the transfer treatment, the depth of liquid remaining on the surface of photosensitive member was about 3μ, and was completely removed by cleaning with a polyurethane blade without leaving any appreciable amount of liquid on the photosensitive member.

EXAMPLE 8

In the same manner as in Example 5, visible figures were formed on a photosensitive member with the depth of liquid developer being about 60μ.

Subsequently, the corona discharge squeezing step was conducted at 6.0 KV to control the liquid depth on the surface of the photosensitive member to 28 to 30μ, and then the figures were transferred by use of corona transfer in about 0.25 sec. to a transfer paper having an oil-absorption coefficient of 50 sec. and a surface smoothness of 50 sec. The transferred figures were dried with hot air. Extremely clear and well-fixed figures were obtained.

After the transfer treatment, the depth of liquid remaining on the surface of the photosensitive member was about 7μ, and was completely removed by cleaning with a polyurethane blade without leaving any appreciable amount of liquid on the photosensitive member.

EXAMPLE 9

In the same manner as in Example 5, visible figures were formed on a photosensitive member with the depth of liquid developer being about 60μ.

Subsequently, the corona discharge squeezing step was conducted at 6.5 KV to control the liquid depth on the surface of the photosensitive member to 10 to 12μ, and then the figures were transferred by use of the corona transfer in about 0.25 sec. to a transfer paper having an oil-absorption coefficient of 300 sec. and a surface smoothness of 200 sec. The transferred figures were dried with hot air. Extremely clear and well-fixed figures were obtained.

After the transfer treatment, the depth of liquid remaining on the surface of the photosensitive member was about 4μ, and was almost completely removed by cleaning with a polyurethane blade until the remaining depth of liquid on the photosensitive member was less than 1μ.

EXAMPLE 10

In the same manner as in Example 5, visible figures were formed on the surface of the photosensitive member with the depth of developer solution being about 60μ.

Subsequently, the corona discharge squeezing step was conducted at 6.4 KV to control the liquid depth on the surface of the photosensitive body to 15μ, and then the figures were transferred by use of the corona transfer in about 0.25 sec. to a film of polyethyleneterephthalate (e.g., "Mylan") having an infinite oil-absorption coefficient (∞ sec.). The transferred figures were dried with hot air. Extremely clear and well-fixed figures were obtained. After the transfer treatment, the depth of liquid remaining on the surface of the photosensitive member was about 7μ and was almost completely removed by cleaning with a polyurethane blade until the remaining depth of liquid on the photosensitive member was less than 1μ.

What is claimed is:

1. For use in transfer electrophotography, a method of optimizing the efficiency of transfer, to a transfer material, of developed images obtained by developing electrostatic images formed on the photosensitive member for electrophotography by a liquid developer, which comprises the steps of controlling the depth of the liquid developer on the surface to a value in the range of 5–30$\mu$ prior to transfer, and then transferring the developed images to the transfer material having an oil absorption coefficient larger than 50 seconds and a smoothness determined by Beck tester in the range of 30–150 seconds in such a manner that the 5–30$\mu$ controlled thickness of the developer on the photosensitive member is reduced to a value in the range of 2–15$\mu$.

2. A method as defined in claim 1, in which the controlling step yields a 10–20$\mu$ thickness of the developer on the surface.

3. In an electrophotographic process including the steps of forming an electrostatic latent image on a photosensitive member for electrophotography, developing the latent image by subjecting the photosensitive member to a liquid developer, conveying the developed image to a transfer material, and thereafter cleaning the photosensitive member, the improvement wherein:

the method comprises the further step of controlling the depth of the developer on the photosensitive member for electrophotography to a value in the range 5–30$\mu$ prior to the conveying step;

the conveying step comprises transferring the developed image onto the transfer material with the transfer material having an oil absorption coefficient larger than 50 seconds and a Beck value in the range of 30–150 seconds in such a manner that the 5–30$\mu$ controlled thickness of the developer is reduced to a value in the range of 2–15$\mu$; and the cleaning step comprises further reducing the 2–15$\mu$ thickness of the developer remaining on the photosensitive member after the transferring step to a value not greater than 1$\mu$.

4. A method as defined in claim 3, in which the photosensitive member comprises a photoconductive layer sandwiched between a conductive support body and an overlying transparent insulating layer.

5. A method as defined in claim 3, in which the controlling step is accomplished by corona discharge squeezing.

6. A method as defined in claim 3, in which the controlling step yields a 10–20 $\mu$ thickness of the developer on the photosensitive member.

7. A method as defined in claim 3, in which the cleaning step is accomplished with a blade.

8. A method as defined in claim 3, in which the cleaning step is accomplished with a blade formed from polyurethane resin.

9. In an electrophotographic process including the steps of forming an electrostatic latent image on a photosensitive member for electrophotography, developing the latent image by subjecting the photosensitive member to a liquid developer including toner particles dispersed in a carrier liquid, conveying the developed image to a transfer material, and thereafter cleaning the photosensitive member, the improvement wherein:

the method comprises the further step of controlling the depth of the carrier liquid on the photosensitive member for electrophotography to a value in the range 10–20$\mu$ prior to the conveying step;

the conveying step comprises transferring the developed image onto the transfer material having an oil absorption coefficient greater than 50 seconds, and a smoothness determined by a Beck tester ranging from 50 to 150 seconds, in such a manner that the 10–20$\mu$ controlled thickness of the carrier liquid prior to transfer is reduced to a value in the range of 2–15$\mu$; and the cleaning step comprises further reducing the 2–15$\mu$ thickness of the carrier liquid remaining on the photosensitive member after the transfer step to a value not greater than 1$\mu$.

10. A method as defined in claim 8, in which the photosensitive member comprises a photoconductive layer sandwiched between a conductive support body and an overlying transparent insulating layer.

11. A method as defined in claim 8, in which the toner particles of the developer have a diameter in the range of 0.5–10 $\mu$, and in which the carrier liquid of the developer has a resistivity greater than $10^9$ ohm-cm.

12. A method as in claim 1, wherein the step of controlling the depth of the liquid developer on the surface of the photosensitive member includes controlling the depth of the liquid developer on the surface of a photosensitive member having a photoconductive layer.

13. A process as in claim 5, wherein the steps involving the photosensitive member include a photosensitive member having a photoconductive layer.

14. A process as in claim 9, wherein the steps involving the photosensitive member include a photosensitive member having a photoconductive layer.

15. In an image forming process including the steps of forming an electrostatic image on a member capable of supporting an electrostatic latent image, developing the latent image by subjecting the member to a liquid developer including toner dispersed in a carrier liquid, conveying the developed image to a transfer material, and thereafter cleaning the insulating layer, the improvement wherein:

the method comprises the further step of controlling the depth of the carrier liquid on the member to a value in the range 5–30$\mu$ prior to the conveying step;

the conveying step comprises transferring the developed image onto the transfer material having an oil-absorption coefficient greater than 50 seconds and a smoothness by Beck tester ranging from 30 to 150 seconds in such a manner that the 5–30$\mu$ controlled thickness of the carrier liquid prior to transfer is reduced to a value in the range of 2–15$\mu$; and the cleaning step comprises further reducing the 2–15$\mu$ thickness of the carrier liquid remaining on the member after transferring step to a value not greater than 1$\mu$.

16. A method as defined in claim 15, in which the controlling step is accomplished by corona discharge squeezing.

17. A method as defined in claim 15, in which the controlling step yields a 10–20$\mu$ thickness of the carrier liquid on the member.

18. A method as defined in claim 15, in which the cleaning step is accomplished with a blade.

19. A method as defined in claim 15, in which the cleaning step is accomplished with a blade formed from polyurethane resin.

* * * * *